US010227817B2

(12) United States Patent
Ting

(10) Patent No.: US 10,227,817 B2
(45) Date of Patent: Mar. 12, 2019

(54) VENTED INSULATED GLASS UNIT

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 15/783,699

(22) Filed: Oct. 13, 2017

(65) Prior Publication Data

US 2018/0320433 A1 Nov. 8, 2018

Related U.S. Application Data

(60) Provisional application No. 62/502,916, filed on May 8, 2017, provisional application No. 62/503,986, filed on May 10, 2017, provisional application No. 62/516,364, filed on Jun. 7, 2017, provisional application No. 62/524,040, filed on Jun. 23, 2017.

(51) Int. Cl.

| | |
|---|---|
| ***E06B 3/663*** | (2006.01) |
| ***E06B 3/24*** | (2006.01) |
| ***E06B 3/67*** | (2006.01) |
| ***E06B 3/64*** | (2006.01) |
| ***E04B 2/88*** | (2006.01) |

(52) U.S. Cl.

CPC ..... *E06B 3/66352* (2013.01); *E04B 2/885* (2013.01); *E06B 3/64* (2013.01); *E06B 3/6715* (2013.01)

(58) Field of Classification Search

None

See application file for complete search history.

(56) References Cited

U.S. PATENT DOCUMENTS

| | | | | | |
|---|---|---|---|---|---|
| 2,872,713 | A | * | 2/1959 | Haas | E06B 3/26301 49/DIG. 1 |
| 2,993,242 | A | * | 7/1961 | Leisibach | E06B 3/24 52/204.593 |
| 3,899,858 | A | * | 8/1975 | Zanker | E06B 3/24 52/172 |
| 4,184,301 | A | | 1/1980 | Ting | |
| 4,316,351 | A | | 2/1982 | Ting | |
| 4,368,226 | A | * | 1/1983 | Mucaria | B32B 17/10055 428/122 |
| 4,685,263 | A | | 8/1987 | Ting | |
| 4,700,520 | A | | 10/1987 | Ting | |
| 4,743,485 | A | | 5/1988 | Ting | |
| 4,765,107 | A | | 8/1988 | Ting | |
| 4,819,405 | A | * | 4/1989 | Jackson | E04C 2/523 52/171.3 |
| 4,840,004 | A | | 6/1989 | Ting | |
| 4,873,805 | A | | 10/1989 | Ting | |
| 4,944,118 | A | * | 7/1990 | Biro | E06B 3/44 49/504 |

(Continued)

*Primary Examiner* — James M Ference
*Assistant Examiner* — Kyle J. Walraed-Sullivan

(57) ABSTRACT

An exterior wall panel with a vented insulated glass unit with the air space between the glass panes pressure equalized with exterior air. The vented insulated glass unit is configured to eliminate the requirement for a perfect seal around the insulated glass unit perimeter, limit water condensation within the insulated glass unit, limit water infiltration, and maintain thermal insulation performance.

6 Claims, 5 Drawing Sheets

(56) References Cited

U.S. PATENT DOCUMENTS

| | | | | |
|---|---|---|---|---|
| 5,048,248 | A | 9/1991 | Ting | |
| 5,107,655 | A * | 4/1992 | Lindgren | A47F 3/043 52/786.1 |
| 5,247,770 | A | 9/1993 | Ting | |
| 5,379,824 | A * | 1/1995 | Carvalho | E06B 3/2605 160/44 |
| 5,452,552 | A | 9/1995 | Ting | |
| 5,596,851 | A | 1/1997 | Ting | |
| 5,598,671 | A | 2/1997 | Ting | |
| 5,687,524 | A | 11/1997 | Ting | |
| 6,357,186 | B1 * | 3/2002 | Gould | E06B 7/10 52/209 |
| 6,393,778 | B1 | 5/2002 | Ting | |
| 6,591,562 | B2 | 7/2003 | Ting | |
| 6,598,361 | B2 | 7/2003 | Ting | |
| 7,134,247 | B2 | 11/2006 | Ting | |
| 8,001,738 | B2 | 8/2011 | Ting | |
| 8,191,325 | B2 | 6/2012 | Ting | |
| 9,611,642 | B2 | 4/2017 | Ting | |
| 2006/0010796 | A1 * | 1/2006 | Akutsu | E06B 3/28 52/204.5 |
| 2009/0120035 | A1 * | 5/2009 | Trpkovski | E06B 3/66309 52/786.13 |
| 2009/0323160 | A1 * | 12/2009 | Egerton | G02F 1/153 359/275 |
| 2011/0011006 | A1 * | 1/2011 | Wuest | E06B 3/221 49/506 |
| 2013/0287975 | A1 * | 10/2013 | Kawami | C09K 3/1018 428/34 |
| 2014/0041326 | A1 * | 2/2014 | Kadavy | E06B 7/16 52/209 |
| 2014/0298740 | A1 | 10/2014 | Ting | |
| 2015/0159422 | A1 * | 6/2015 | Pettit, III | E06B 3/263 52/204.591 |

* cited by examiner

VENTED INSULATED GLASS UNIT

CROSS-REFERENCE TO RELATED APPLICATIONS

This application claims the benefit under 35 U.S.C. § 119(e) of the earlier filing dates of U.S. Provisional Patent Application No. 62/502,916, filed May 8, 2017, U.S. Provisional Patent Application No. 62/503,986, filed May 10, 2017, U.S. Provisional Patent Application No. 62/516,364, filed Jun. 7, 2017, and U.S. Provisional Patent Application No. 62/524,040, filed Jun. 23, 2017.

BACKGROUND OF THE INVENTION

1. Field of the Invention

This invention is related to insulated glass design for use in building exterior wall systems such as curtain wall, window wall, and punch-out window.

2. Description of the Background

An insulated glass unit, commonly known in the industry as an IG unit, comprises a perimeter spacer bar sandwiched between an exterior single glass pane and an interior single glass pane. The two glass panes are bonded and air sealed to the spacer bar normally with shop-applied silicone caulking. The spacer bar is located inwardly away from the edges of the glass at a small distance, normally about 2 to 4 mm, to create a complete loop-around perimeter channel for additional shop-applied air seal caulking around the entire perimeter of the IG unit. The above shop sealing method is intended to form a long-lasting perfect seal around the IG unit.

The air trapped inside the IG unit provides two important performance functions, namely, thermal insulation and wind load transfer between the exterior glass pane and the interior glass pane. For a positive wind load acting on the exterior glass pane of the IG unit, the dead air space within the IG unit will be in compression, creating a positive differential air pressure relative to the interior air. The differential air pressure will push the interior glass pane inwardly, allowing the sharing of the positive wind load. For a negative wind load acting on the exterior glass pane of the IG unit, the dead air space within the IG unit will be in expansion, creating a negative differential air pressure relative to the interior air. This differential air pressure will push the interior glass pane outwardly, allowing the sharing of the negative wind load.

It is well known in the industry that the shop-applied perfect perimeter seal around the IG unit will inevitably fail in the form of hair line cracks due to stresses caused by relative structural movements and/or aging of the sealant material. For example, perimeter seal failures are often experienced when IG units are shipped over mountainous areas due to air pressure changes in combination with the effect of structurally unrestrained perimeter edges of the IG units. For the in-service condition of the IG unit (i.e., being glazed in a wall system), perimeter seal failure is normally identified from observation of a change in certain performance functions. The noticed change in the performance functions is unacceptable to building owners and the only repair is to replace the failed IG unit.

The following terminology regarding an IG unit will be used: (1) Face 1: the outside-facing surface of the exterior glass pane; (2) Face 2: the inside-facing surface of the exterior glass pane; (3) Face 3: the outside-facing surface of the interior glass pane; (4) Face 4: the inside-facing surface of the interior glass pane. The terms "outside-facing" and "inside-facing" refer to the direction the glass pane faces, when the IG unit is installed, relative to the building exterior and interior. Thus, "outside-facing" refers to the surface facing the building exterior and "inside-facing" refers to the surface facing the building interior.

It can be readily understood that similar to a flat tire condition, if the perfect seal around the IG unit becomes imperfect allowing air leakage, the structural function of the IG unit will be impaired. This change of performance function is not noticeable in the early stages of seal failure.

The effect of a hair line crack in the perimeter seal of an IG unit in a conventional exterior wall system is explained as follows. The IG unit is normally glazed into the wall system frame by using a double air-seal system (i.e., air seal around both the exterior and the interior perimeters of the IG unit). The glazing air seal can never be considered a perfect seal, and moisture migration through the glazing air seal is inevitable. Due to vapor pressure, the moisture migration will be in the direction from a high absolute humidity zone to a low absolute humidity zone. For example, in a heated and humidified building during the winter time, interior moisture will migrate through the interior glazed seal line into the joint cavities around the perimeter edges of the IG unit, then through hair line cracks in the perimeter seal into the dead air space of the IG unit, causing water condensation on Face 2 of the IG unit. Similarly, in an air-conditioned building during a humid summer day, exterior moisture will migrate through the exterior glazed seal line into the joint cavities around the perimeter edges of the IG unit, then through hair line cracks in the perimeter seal into the dead air space of the IG unit, causing water condensation on Face 3 of the IG unit. This kind of change in performance function is immediately noticeable (commonly known as a fogged IG unit) and unacceptable to the building occupant. The only solution is to replace the impaired IG unit.

Another example of change in performance function caused by water infiltration is explained as follows. When exterior rain water infiltrates through the exterior glazed seal line, due to the surface tension of a water drop, the infiltrated water can run slowly along the perimeter seal surface and in contact with hair line cracks in the perimeter seal. During positive dynamic wind load cycles, water may infiltrate through the hair line cracks into the dead air space of the IG unit as explained below. The deformation of the exterior glass pane under a positive wind load will cause an air exhalation from the dead air space of the IG unit through hair line cracks in the perimeter seal. Once the positive wind load starts to recede, a negative pressure is created inside the dead air space causing the water running over a portion of a hair line crack to be sucked into the dead air space of the IG unit. Once the water has infiltrated into the dead air space, it will flow downwardly and accumulate on top of the bottom segment of the spacer bar. Even if some hair line cracks exist in the bottom perimeter seal, the surface tension of a water drop prevents water drainage through the hair line cracks. Therefore, dynamic positive wind load cycles create a one-way pumping action that sucks water into the dead air space of the IG unit. This problem has been observed in curtain wall projects with large IG units due to the fact that the larger the size of the IG unit, the bigger the pumping force. This kind of change in performance function is immediately noticeable and unacceptable to the building occupant, and the only solution is to replace the impaired IG unit.

A major cause of the above-discussed problems is the requirement of a perfect seal design using caulking along the perimeter of the IG unit. It is desirable to eliminate the discussed functional performance problems by having an IG unit design that does not require a perimeter caulking seal.

SUMMARY OF THE INVENTION

Preferred aspects of the invention provide a method of shop-assembling a vented IG unit without caulking along the glass perimeter for use in a pressure-equalized exterior wall or window unit. Preferred embodiments of the disclosed vented IG units provide options for improving thermal and sound insulation values and permit easy replacement of the interior glass pane from the building interior without causing weather exposure during replacement.

DETAILED DESCRIPTION OF THE INVENTION

Figure 1:
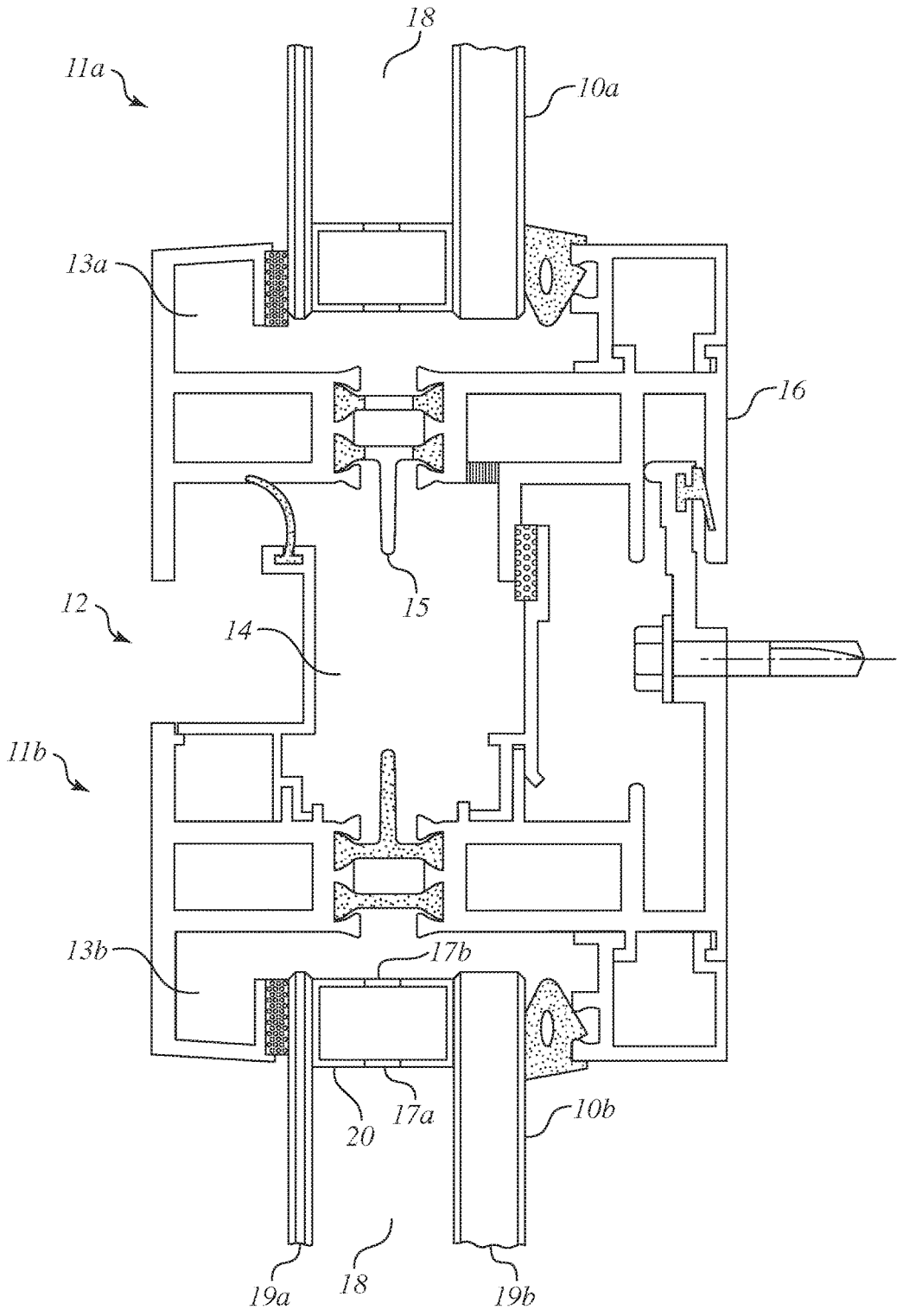
FIG. 1 shows the horizontal panel joint of a typical airloop curtain wall system with glazed-in vented IG units of the present invention.

FIG. 1 shows the horizontal panel joint 12 between a top panel 11*a* and a bottom panel 11*b* of a typical airloop curtain wall system (see U.S. Pat. No. 7,134,247, which is incorporated by reference herein). Each panel has a perimeter frame with a glazed-in vented IG unit (i.e., vented IG unit in top panel 11*a* and vented IG unit in bottom panel 11*b*). The air space 14 formed between the sill frame member of top panel 11*a* and the head frame member of bottom panel 11*b* is the horizontal segment of the pressure equalized outer airloop. As explained in U.S. Pat. No. 7,134,247, this outer airloop is formed around each airloop curtain wall panel when airloop curtain wall panels are assembled together. The open panel joint 12 permits pressure equalization of air space 14 with exterior air.

An inner airloop is formed about the perimeter of the IG unit in the perimeter frame of each airloop curtain wall panel. The air space 13*b*, formed between the head frame member and the IG unit, is the top segment of the pressure equalized inner airloop of the bottom panel 11*b*. The inner airloop is formed around the IG unit in corresponding, connected air spaces formed between the IG unit and jamb frame members, and between the IG unit and the sill frame member of the bottom panel 11*b*.

The sill frame member of the bottom panel 11*b* has the same configuration as the sill frame member of the top panel 11*a*, as shown in FIG. 1. The blank portion shown in the thermal break 15 of the sill frame member 16 of the top panel 11*a* represents air holes connecting the air space 14 and the air space 13*a*. The air space 13*a* is the bottom segment of the pressure equalized inner airloop of the top panel 11*a*. Therefore, the inner airloop of the top panel 11*a* is pressure equalized through the air holes in the thermal break 15 between air spaces 14 and 13*a*, and the inner airloop of the bottom panel 11*b* is pressure equalized through corresponding air holes in the thermal break of the sill frame member of the bottom panel 11*b*.

The vented IG unit has an exterior glass pane 19*a* and an interior glass pane 19*b* separated by a spacer bar 20 without glass perimeter caulking, creating the air space 18 between the exterior glass pane 19*a* and the interior glass pane 19*b* within the bottom panel IG unit 10*b*. The spacer bar 20 has air holes 17*a* and 17*b* to pressure equalize the air space 18 with inner airloop air space 13*b*. The air hole 17*a* is the inner air hole on the inner flange of the spacer bar 20 represented by the dotted lines and the air hole 17*b* is the outer air hole through the outer flange of the spacer bar 20. In alternative embodiments, the spacer bar is a solid member with at least one air hole to pressure equalize the air space in the IG unit with the inner airloop air space.

Due to the pressure equalization of the air space 18, no differential air pressure between the air space 18 and the surrounding air will be created during transportation of the IG unit. The IG unit typically would be structurally secured in the wall panel 11*b* prior to shipping. Thus, the potential problem of perimeter seal damage of a conventional IG unit caused by air pressure changes during transit is eliminated.

To explain the functional performance of the present invention, the following notations will be used.

$D_i$=dew point of the building interior air $D_e$=dew point of the building exterior air $T_i$=building interior air temperature $T_e$=building exterior air temperature $T_a$=air temperature inside the air space 18

$T_1$=surface temperature on Face 1 (i.e. outside surface of exterior glass pane 19*a*)

$T_2$=surface temperature on Face 2 (i.e. inside surface of exterior glass pane 19*a*)

$T_3$=surface temperature on Face 3 (i.e. outside surface of interior glass pane 19*b*)

$T_4$=surface temperature on Face 4 (i.e. inside surface of interior glass pane 19*b*)

During the heating season of the winter time, the following temperature relationship is always true.

$$D_e<T_e<T_1<T_2<T_3<T_4<T_i>D_i$$

Due to pressure equalization of air space 18, air space 18 is within the exterior air zone (i.e., cold and low absolute humidity zone). From the above temperature relationship, it is impossible for the surface temperature of Face 2 or Face 3 to become less than the exterior air dew point, $D_e$. Therefore, potential water condensation on Face 2 or Face 3 (i.e., fogged IG problem) is eliminated.

During the air conditioning season of the summer time, the following temperature relationship is always true.

$$D_e<T_e>T_1>T_2>T_3>T_4>T_i>D_i$$

Due to the pressure equalization of air space 18, air space 18 is within the exterior air zone (i.e., hot and high absolute humidity zone). From the above temperature relationship, it is possible for the surface temperature of Face 3 to become less than the exterior dew point, $D_e$. Therefore, water condensation on Face 3 (i.e. Fogged IG problem) is possible. However, the probability of water condensation on Face 3 is low and can be ignored in design considerations for the following reasons:

1. As compared to the heating season in cold regions, the differential temperature between the exterior air and the interior air is much less in hot regions during the air conditioning season.

2. For the most commonly used panel frame material, aluminum, during the air conditioning season, the interior surface temperature of the aluminum extrusion frame will be lower than temperature of Face 3 on the glass surface. Therefore, water condensation on the aluminum frame surface inside the hidden air spaces 13*a* and 13*b* will happen first, resulting in reduced moisture content in the air before the air can go through air holes 17*a* and 17*b* to reach Face 3 on the glass surface. The condensed water on the hidden surface of the aluminum frame will be drained out from the airloop drainage system.

If exterior water infiltrates into the inner airloop and makes contact with the contact seam between the spacer bar 20 and the glass pane 19*a* or 19*b*, it will not cause water infiltration into air space 18 because air space 18 is pressure equalized with the inner airloop. Thus, the problem of water infiltration through hair line cracks into air space 18 as well as water accumulation at the bottom of air space 18 is eliminated.

For thermal insulation performance, it is well known in the industry that a dead air space will provide good thermal insulation, which is the basis of conventional IG unit design. In a light or no wind condition, the vented IG unit design of the present invention has no impact on the thermal insulation performance. In a windy condition, there will be a small air exchange between the air space 18 and the air space 13*b*. However, the effect of the small air exchange on the thermal insulation performance is insignificant, as evidenced by nearly two decades of field performance of erected airloop curtain wall systems. The good field thermal insulation performance of erected airloop curtain wall systems can be explained by a thermal sponge theory where in a windy condition, most of the air inside the inter-connected airloops can simply move from a higher pressure airloop zone to a lower pressure airloop zone without being pushed out of the airloops (i.e., no significant air exchange between the air in the airloops and the exterior air). In a solar gain condition, hot air in air space 18 will be vented out through air holes 17*a* and 17*b*. This is beneficial in the air-conditioning season. In summary, the overall effect of the vented IG unit design has little effect on the thermal insulation performance compared to a conventional, sealed IG unit.

Figure 2:
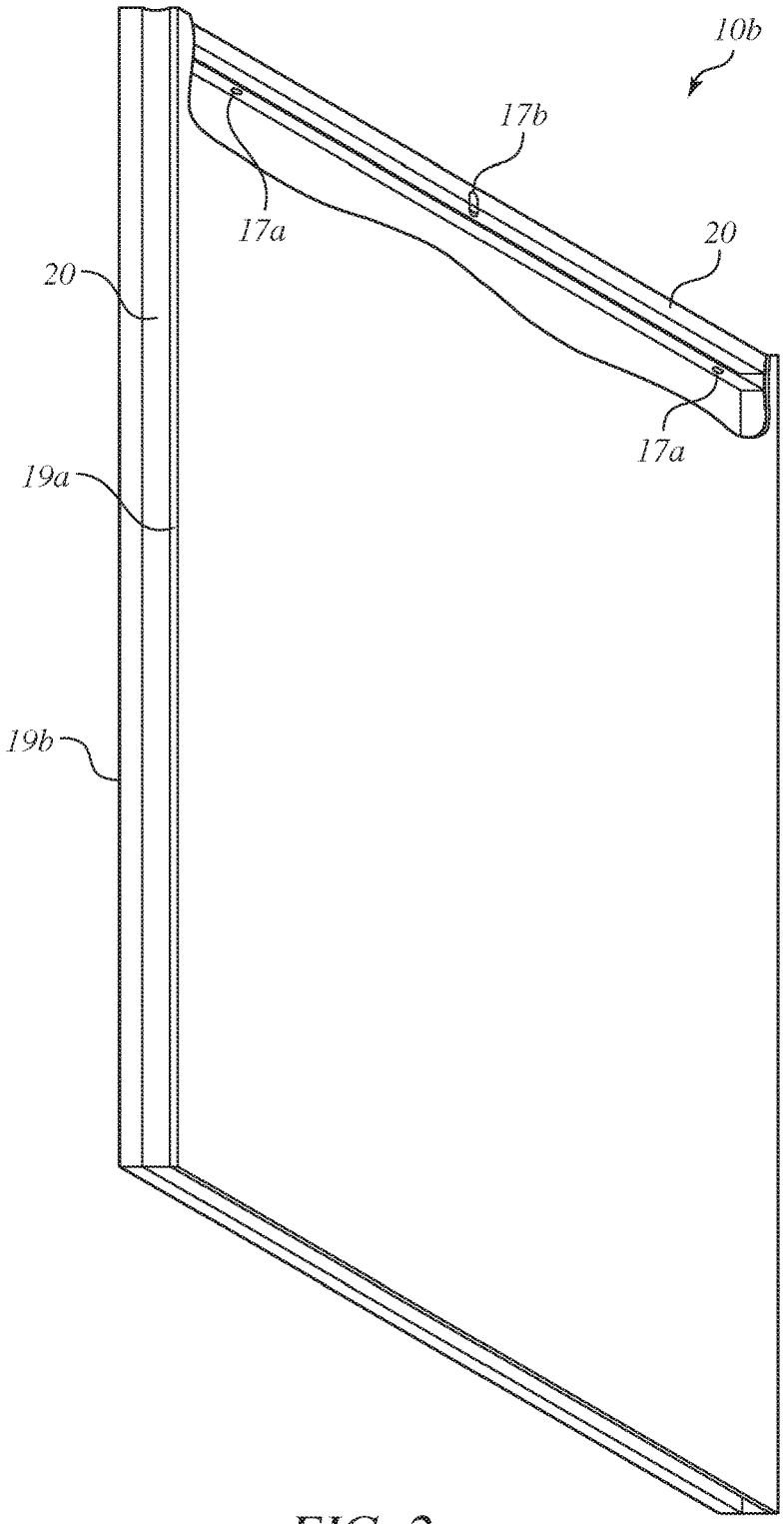
FIG. 2 shows an isometric view of a vented IG unit of the present invention with partially cut away exterior glass pane to illustrate the preferred venting air hole locations.

FIG. 2 shows an isometric view of the vented IG unit 10*b* as shown in FIG. 1, with a partially cut away exterior glass pane to illustrate the preferred venting air hole locations. The vent air holes 17*a* and 17*b* are preferably pre-drilled in the spacer bar 20 before assembly into the airloop panel frame. To reduce the probability of insects and airborne dirt entering air space 18, the locations of the air holes 17*a* and 17*b* are preferably offset as shown in FIG. 2. The air holes may optionally be filled with a filtering material to prevent entry of insects and dirt.

Figure 3:
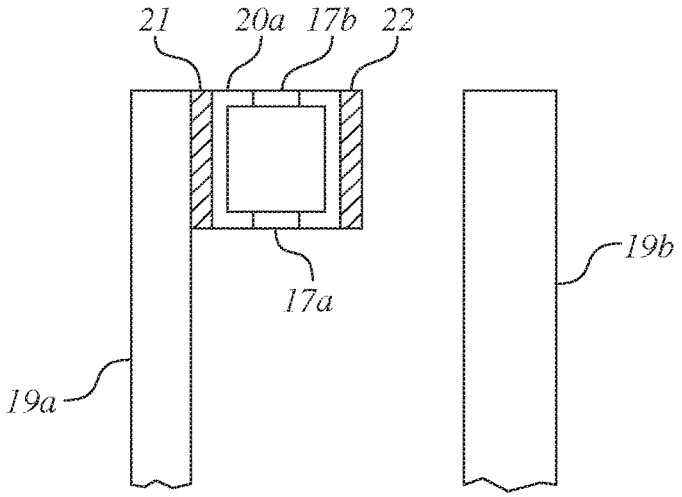
FIG. 3 shows a construction detail of the IG perimeter of a preferred embodiment of the present invention.

FIG. 3 shows an alternate construction detail of an IG unit perimeter of a preferred embodiment of the present invention. Eliminating the perimeter caulking provides the following advantages.

1. It eliminates shop labor needed to assemble the IG unit.

2. It eliminates the wait time for curing of the perimeter caulking in the shop, resulting in a significant shop space saving.

3. The air holes 17*a* and 17*b* can be pre-drilled and all drill shavings cleaned before assembling the IG unit into the airloop panel frame.

4. Quick curing adhesive such as epoxy or double-sided adhesive tape can be used as a sealing agent 21 between the exterior glass pane 19*a* and the spacer bar 20, and as a sealing agent 22 between the interior glass pane 19*b* and the spacer bar 20.

5. If the interior glass pane 19*b* is a special functioning glass such as a commercial glass known as "smart-tinting" dynamic glass or a solar energy unit, the ease of replacing a dysfunctional special glass pane in an erected wall is an important design consideration. For this consideration, the sealing agent 22 on the side of the special functioning glass 19*b* may be a one-sided adhesive sealing foam tape 22 for easy replacement of a dysfunctional special glass 19*b* and significant cost savings by re-using the exterior glass pane 19*a*. The airloop system shown in FIG. 1 provides interior access for easy replacement of the interior glass pane of the IG unit. The adhesive side of the one-sided adhesive sealing foam tape 22 is adhered to the spacer bar 20 and the non-adhesive side forms a dirt-repelling seal with the special functioning glass 19*b* in the shop glazing operation.

6. Since the outside flange of the spacer bar 20 is exposed to the pressure equalized air space 13*b*, a material with a low thermal conductivity such as PVC is preferred to be used for the spacer bar.

Figure 4:
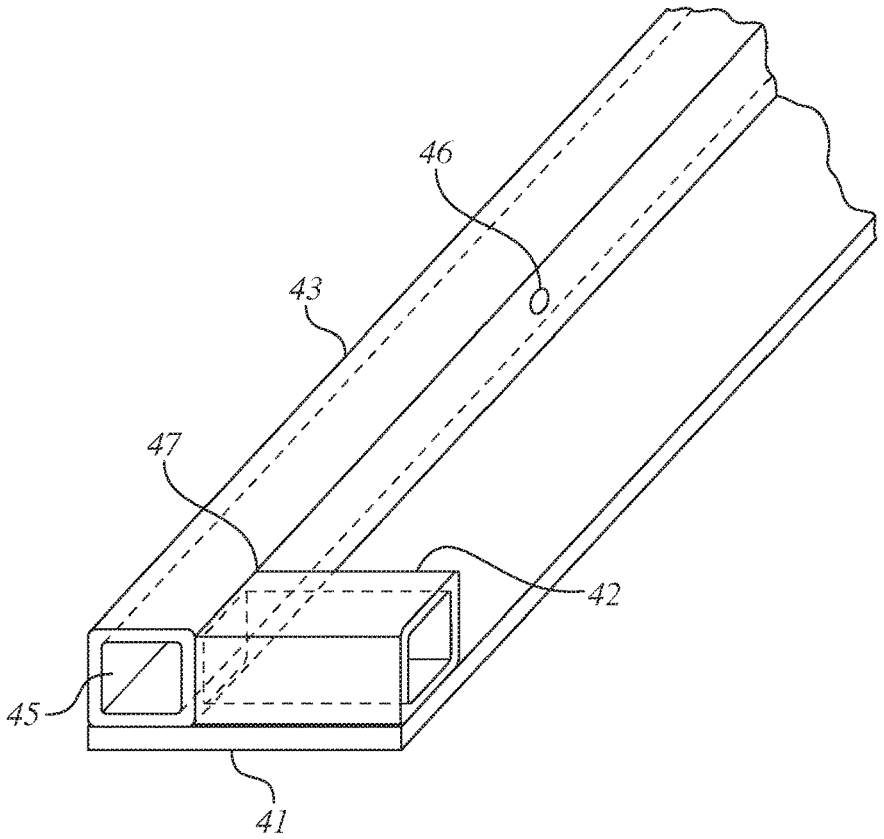
FIG. 4 shows a construction detail of the IG perimeter of another preferred embodiment with an alternate arrangement for venting the IG unit.

FIG. 4 is an isometric cut-away view of an alternate construction detail of the IG unit perimeter of another preferred embodiment. For clarity, only one glass pane 41 is shown. The glass pane 41 may be either the interior or exterior glass pane of the IG unit. The horizontal spacer bar 42 between the glass panes is butt-ended against the side of the vertical spacer bar 43. Each open end of the vertical spacer bar 43 is approximately flush with the top and bottom glass edges, respectively. When an IG unit having such an open end design is installed in an airloop system, configured as shown in FIG. 1, the open ends of vertical spacer bar 43 will connect and pressure equalize air space 45 inside the vertical spacer bar with airloop air spaces 13*a* and 13*b*. To pressure equalize the air space between the glass panes of such an IG unit (equivalent to air space 18 shown in FIG. 1), at least one predrilled air hole 46 (similar to air hole 17*a* on spacer bar 20 shown in FIGS. 1 and 3) may be provided on the inside face of the spacer bar 43. No air hole is needed on the outside face of the spacer bar 43. To maximize thermal insulation performance, air hole 46 preferably is located as far as possible from exterior air (i.e., near the mid-height of the IG unit), and the inside corner 47 of the butt joint between the horizontal spacer bar 42 and the vertical spacer bar 43 preferably is air sealed.

Summarizing from the above, shop assembling a vented IG unit without glass perimeter caulking into an airloop panel frame eliminates many problems associated with conventional IG units.

Even though the vented IG unit design is shown in FIG. 1 in a typical airloop curtain wall system, it can be used on any pressure equalized curtain wall, window wall, or punch-out window system. Similarly, the embodiment of FIG. 4 may be used on any pressure equalized curtain wall, window wall, or punch-out window system. However, the pressure equalized air space in a conventional system normally is a segmented air space with end blocks resulting in a very short path for the exterior air to reach the pressure equalized air space where the air hole 17*b* or the open end of the vertical spacer bar 43 is located. Due to the short path for the exterior air to reach the location of the air hole 17*b* of the open end of the vertical spacer bar 43, the efficiency in thermal insulation performance is reduced as compared to an airloop system.

Figure 5:
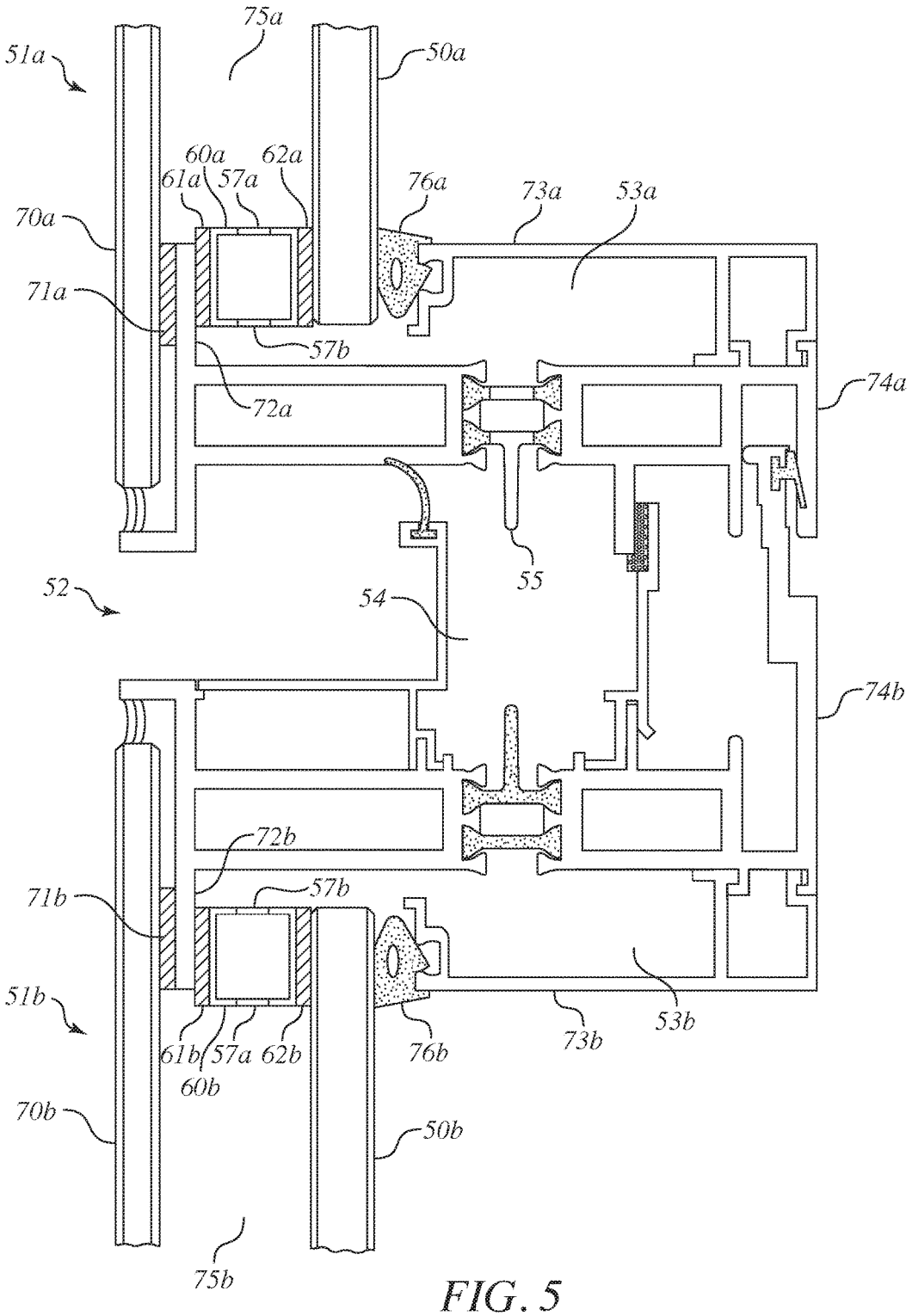
FIG. 5 shows a horizontal panel joint between a top panel and a bottom panel of a typical airloop hidden frame curtain wall system with glazed-in vented IG units of the present invention.

FIG. 5 shows a horizontal panel joint 52 between a top panel 51*a* and a bottom panel 51*b* of a typical airloop hidden frame curtain wall system with a glazed-in vented IG unit in each of the panels. Because the curtain wall panels with a vented IG unit do not require a prefabricated, sealed IG unit, the curtain wall panels may be configured such that the interior glass of the vented IG unit is accessible from the building interior for easy replacement. The exterior glass for each wall panel is mounted on the exterior side of the panel perimeter frame. As shown in FIG. 5, the exterior glass 70*a* of the top panel 51*a* is bonded to the exterior side of the mounting flange 72*a* of the perimeter frame sill member 74*a* with structural adhesive agent 71*a*. Similarly, the exterior glass 70*b* of the bottom panel 51*b* is bonded to exterior side of the mounting flange 72*b* of the perimeter frame head member 74*b* with structural adhesive agent 71*b*. The functions of the exterior glass 70*a*, 70*b* include exterior frameless aesthetic performance and weather barrier performance.

Unlike use of a conventional, prefabricated, sealed IG unit, which would be completely mounted on the exterior side of the frame mounting flange in a hidden frame system, the interior glass of a vented IG unit may be mounted on the interior side of the mounting flange, such that an inner airloop is formed in the perimeter frame about the perimeter of the interior glass. The interior glass 50*a* is glazed into the sill member 74*a* of the top panel 51*a* using the removable glazing bead 73*a* with the sealing gasket 76*a*. The interior glass 50*a* is structurally secured between the interior side of the mounting flange 72*a* of the hidden frame sill member 74*a* and the glazing bead 73*a* using a spacer bar 60*a* with interface sealing agent 61*a* between the spacer bar 60*a* and the interior side of the mounting flange 72*a*, and interface sealing agent 62*a* between the spacer bar 60*a* and the interior glass 50*a*. Similarly, the interior glass 50*b* is glazed into the head member 74*b* of the bottom panel 51*b* using the removable glazing bead 73*b* with a sealing gasket 76*b*. The interior glass 50*b* is structurally secured between the mounting flange 72*b* of the hidden frame head member 74*b* and the glazing bead 73*b* using a spacer bar 60*b* with interface sealing agents 61*b* and 62*b*.

The sealing agents 61*a* and 62*a* are provided to prevent insects and dirt from entering the air space 75*a* between the exterior glass 70*a* and interior glass 50*a*. For the same reason, the air holes 57*b* exposed to the inner airloop space 53*a* preferably are filled with air filtering material. The sealing agents 61*b* and 62*b* shown in the lower panel are similarly provided to prevent insects and dirt from entering the air space 75*b*, and the air holes 57*b* preferably are filled with air filtering material. The sealing agents 61*a*, 62*a*, 61*b*, and 62*b* may be an adhesive such as epoxy or an adhesive tape. The sealing agents 61*a*, 61*b* between the mounting flanges 72*a*, 72*b* and the spacer bars 60*a*, 60*b*, preferably are a two-sided adhesive tape. The sealing agents 62*a*, 62*b* between the spacer bars 60*a*, 60*b* and the interior glass 50*a*, 50*b* preferably are a one-sided adhesive tape with the adhesive side adhered to the spacer bars 60*a*, 60*b* to permit easy replacement of the interior glass 50*a*, 50*b*.

The following pressure equalization process is explained with the understanding that the head member of top panel 51*a* will have the same configuration as the head member 74*b* shown for the bottom panel 51*b* in FIG. 5. Exterior air enters through the open panel joint 52 into the outer airloop space 54, and then through the air holes 55 into the inner airloop space 53*a* in sill member 74*a*. The inner airloop formed by corresponding airspaces in the sill, jamb, and head members of the panel frame connects inner airloop space 53*a* in the sill member of top panel 51*a* with the inner airloop space in the head member of top panel 51*a* (analogous to inner airloop space 53*b* shown in bottom panel 51*b*). Air holes 57*a*, 57*b* connect air in the inner airloop spaces to the air space 75*a* between the exterior glass 70*a* and interior glass 50*a*, pressure equalizing air space 75*a* with the inner airloop spaces 53*a*, 53*b*.

For a typical airloop hidden frame system, it is impossible to replace a dysfunctional IG unit from the building interior because the entire IG unit (i.e., both the exterior and interior glass) is mounted on the exterior side of the mounting flange of the frame. In contrast, the interior glass of the embodiment shown in FIG. 5 can be replaced from the building interior. If interior glass 50*a* needs to be replaced (e.g., a dysfunctional solar energy glass or smart tinting glass), interior glass 50*a* can be replaced from the interior side of the building by removing the gasket 76*a* and the glazing bead 73*a* to gain access. For easy replacement of the interior glass 50*a*, it is desirable that the sealing agent 61*a* is bonded to the flange 72*a* and the spacer bar 60*a* while the sealing agent 62*a* is only bonded to the spacer bar 60*a* without bonding to the interior glass 50*a*. In this arrangement, interior glass 50*a* can be easily replaced from the interior side without disturbing the spacer bar 60*a*. As shown, the interior glass 50*a* is a single pane glass, but the interior glass also may be a unit with multiple panes of glass (e.g., a functional glass with multiple glass panes).

Figure 6:
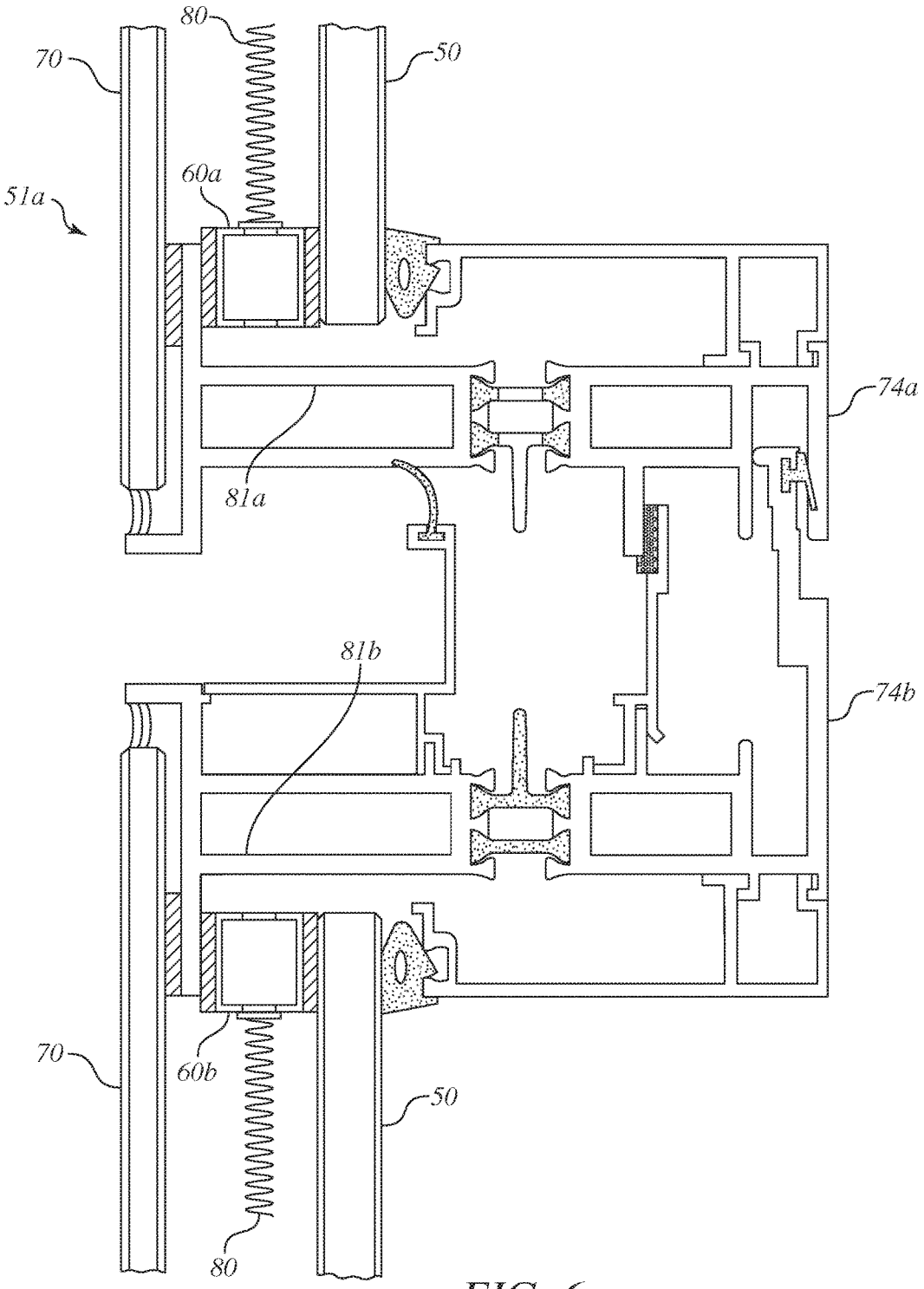
FIG. 6 shows a horizontal panel joint between a top panel and a bottom panel of a typical airloop hidden frame curtain wall system with glazed-in vented IG units of the present invention, including an operable solar shading system.

FIG. 6 shows the horizontal panel joint shown in FIG. 5, except that the embodiment shown in FIG. 6 includes an operable solar shading system 80 within the air space between the exterior glass 70 and the interior glass 50 of the panels. The following description of FIG. 6 is made with the understanding that the head member of top panel 51*a* will have the same configuration as the shown head member 74*b* for the bottom panel, and the sill member of the bottom panel will have the same configuration as shown for sill member 74*a* of the top panel. Because the depth of the air space between the two panes of glass can be adjusted to accommodate a specific operable solar shading system, practically all operable solar shading systems available in today's market can be installed in a wall panel of the present invention.

Because the wall panels with a vented IG unit of the present invention do not require a prefabricated, sealed IG unit, the vented IG unit may be assembled when the wall panel is assembled. For example, in the embodiment shown in FIG. 1, the exterior glass 19*a* may be attached to the perimeter frame with a two-sided adhesive tape. Next, the spacer bar 20 is positioned around the perimeter of the exterior glass 19*a*. The spacer bar 20 preferably is attached to the exterior glass 19*a* using a sealing agent such as a two-sided adhesive tape. The interior glass 19*b* is then placed against spacer bar 20, preferably with a sealing agent in between the spacer bar 20 and the interior glass 19*b*, and the assembled vented IG unit is glazed into the perimeter frame with a glazing bead and gasket.

The hidden frame wall embodiment shown in FIG. 5 may be assembled using a similar procedure. First, the spacer bar 60*a* is positioned against the interior side of the mounting flange 72*a*. The spacer bar 60*a* preferably is attached to the mounting flange 72*a* with a sealing agent 61*a*, such as a two-sided adhesive tape. Next, the interior glass 50*a* is positioned against the spacer bar 60*a*, preferably with a sealing agent 62*a* in between the spacer bar 60*a* and the interior glass 50*a*. The spacer bar 60*a* and interior glass 50*a* are then glazed into the perimeter frame with a glazing bead 73*a* and gasket 76*a*. Next, the exterior glass 70*a* can be mounted to the mounting flange 72*a* using structural adhesive agent 71*a* to form the vented IG unit.

The solar shading system can be secured in position by fasteners (not shown) through the spacer bar 60*b* into the flange 81*b* in the head frame 74*b* at the top and/or through the spacer bar 60*a* into the flange 81*a* in the sill frame 74*a* at the bottom. Because the interior glass 50 can be easily removed from the building interior as explained in the description of FIG. 5, the operable solar shading system 80 may be easily accessed for maintenance or replacement, including changing to a different operable solar shading system.

The present invention may be applied to any commercially available operable window system or punch-out window system or pressure equalized window wall system by providing a means to allow exterior air to enter the perimeter air space around the interior glass without causing water leakage. For example, a shielded air entering gap can be provided below the spacer bar along the bottom edge of the interior glass.

Nothing in the above description is meant to limit the present invention to any specific materials, geometry, or orientation of elements. Various changes could be made in the construction and methods disclosed above without departing from the scope of the invention are contemplated within the scope of the present invention and will be apparent to those skilled in the art. The embodiments described herein were presented by way of example only and should not be used to limit the scope of the invention.

The invention claimed is:

1. An airloop wall panel comprising:

a perimeter frame comprising a mounting flange having an exterior side and an interior side, a head frame member, a first jamb frame member, a second jamb frame member, and a sill frame member;

an exterior glass pane mounted to the exterior side of said mounting flange;

a spacer bar mounted to the interior side of said mounting flange;

an interior glass pane mounted to an interior side of said spacer bar, forming an air space between said exterior glass pane and said interior glass pane;

an inner airloop formed in said perimeter frame bordering a perimeter of said interior glass pane and not bordering a perimeter of said exterior glass pane, said inner airloop comprising connected air spaces formed between said interior glass pane and said head frame member, between said interior glass pane and said first jamb frame member, between said interior glass pane and said second jamb frame member, and between said interior glass pane and said sill frame member; and a hole in said spacer bar, said hole pressure equalizing said air space between said exterior glass pane and said interior glass pane with said inner airloop.

2. The wall panel of claim 1, further comprising an operable solar shading system in said air space.

3. The wall panel of claim 1, wherein said interior glass pane is a solar energy unit.

4. The wall panel of claim 1, wherein said interior glass pane is a tinting dynamic glass.

5. The wall panel of claim 1, further comprising a sealing agent between said spacer bar and said interior glass pane.

6. The wall panel of claim 5, wherein said sealing agent is a one-sided adhesive tape adhered to said spacer bar.

* * * * *